US010487453B2

(12) United States Patent
Niedzwiecki

(10) Patent No.: US 10,487,453 B2
(45) Date of Patent: Nov. 26, 2019

(54) METHODS FOR TREATING PAPERBOARDS AND PAPER MEDIA, AND ASSOCIATED TREATED PAPERBOARDS AND PAPER MEDIA

(71) Applicant: BASF SE, Ludwigshafen am Rhein (DE)

(72) Inventor: Daniel Niedzwiecki, Trenton, MI (US)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 15/575,134

(22) PCT Filed: May 18, 2016

(86) PCT No.: PCT/US2016/033048

§ 371 (c)(1),
(2) Date: Nov. 17, 2017

(87) PCT Pub. No.: WO2016/187282

PCT Pub. Date: Nov. 24, 2016

(65) Prior Publication Data

US 2018/0298557 A1 Oct. 18, 2018

Related U.S. Application Data

(60) Provisional application No. 62/162,866, filed on May 18, 2015.

(51) Int. Cl.

| | |
|---|---|
| ***D21H 21/18*** | (2006.01) |
| ***D21H 17/57*** | (2006.01) |
| ***D21H 19/16*** | (2006.01) |
| ***D21H 19/24*** | (2006.01) |
| ***D21H 19/26*** | (2006.01) |
| ***D21H 19/30*** | (2006.01) |
| ***D21H 19/82*** | (2006.01) |
| ***D21H 23/72*** | (2006.01) |
| ***D21J 1/08*** | (2006.01) |

(52) U.S. Cl.

CPC ..... *D21H 21/18* (2013.01); *D21H 17/57* (2013.01); *D21H 19/16* (2013.01); *D21H 19/24* (2013.01); *D21H 19/26* (2013.01); *D21H 19/30* (2013.01); *D21H 19/82* (2013.01); *D21H 23/72* (2013.01); *D21J 1/08* (2013.01)

(58) Field of Classification Search

USPC ..... 162/135

See application file for complete search history.

(56) References Cited

U.S. PATENT DOCUMENTS

| | | | |
|---|---|---|---|
| 3,056,835 | A | 10/1962 | Monagle et al. |
| 3,152,131 | A | 10/1964 | Heberling |
| 3,406,197 | A | 10/1968 | Ulrich |
| 3,406,198 | A | 10/1968 | Budnick |
| 3,522,303 | A | 7/1970 | Ulrich |
| 3,778,302 | A | 12/1973 | Dahl |
| 3,953,169 | A | 4/1976 | Igarashi et al. |
| 4,143,063 | A | 3/1979 | Alberino et al. |
| 4,617,223 | A | 10/1986 | Hiscock et al. |
| 5,674,568 | A | 10/1997 | Layton et al. |
| 6,140,412 | A | 10/2000 | Saitoh et al. |
| 2009/0240004 | A1 | 9/2009 | Maier et al. |
| 2011/0008619 | A1 | 1/2011 | Murphy et al. |

FOREIGN PATENT DOCUMENTS

| | | | |
|---|---|---|---|
| WO | 2009/130269 | A1 | 10/2009 |

OTHER PUBLICATIONS

International Search Report and Written Opinion from corresponding International Application No. PCT/US2016/033048, dated Jan. 5, 2017.

International Preliminary Report on Patentability from corresponding International Application No. PCT/US2016/033048, dated Nov. 30, 2017.

*Primary Examiner* — Mark Halpern

(74) *Attorney, Agent, or Firm* — DLA Piper LLP (US)

(57) ABSTRACT

Methods for treating paperboard or paper media are provided. In these methods, a composition is applied to the surface of the paperboard or paper media. Paperboards or paper media treated in accordance with any of the methods achieved increased strength under both dry and wet testing methodologies as compared with untreated paperboards and paper media of the same basis weight.

15 Claims, No Drawings

METHODS FOR TREATING PAPERBOARDS AND PAPER MEDIA, AND ASSOCIATED TREATED PAPERBOARDS AND PAPER MEDIA

CROSS-REFERENCE TO RELATED APPLICATIONS

This application claims priority to U.S. Provisional Application No. 62/162,866, filed May 18, 2015, the content of which is incorporated herein by reference.

BACKGROUND OF THE INVENTION

1. Field of the Invention

The subject invention generally relates to methods for treating paperboards and paper media to increase their strength and barrier properties and to associated treated paperboards and paper media.

2. Description of the Related Art

Paperboards and other paper media are commonly used in the packaging and printing industries to package and protect a wide variety of goods. For example, it is common to use paperboard cartons for carrying glass bottles or cans. Such paperboard cartons may include a series of die cut openings, perforations or folds, depending upon their desired end use.

The strength and durability of such paperboards is largely defined by the basis weight of the paperboard, generally defined as the weight in pounds of 1000 square feet of paperboard. For carrier board, a paperboard commonly used in the manufacture of 12 pack or 6 pack container dispensers, the basis weight is typically 21-26 point.

It is also a common practice to selectively reinforce, or treat, the entirety or selective portions of the paperboard that are prone to failure during use by applying a coating to the surface of the paperboard or otherwise impregnating the porous paperboard with certain resins that may increase compressive strength, tensile strength, tearing strength, flexibility moisture or barrier properties, etc.

SUMMARY OF THE INVENTION AND ADVANTAGES

The subject application refers to methods for increasing the strength and barrier properties of paperboard or paper media.

In one embodiment, the method comprises the steps: providing a first composition which comprises at least one component selected from a multifunctional alcohol, an amine, an amine derivative, a tin-based catalyst, and combinations thereof; providing a second composition comprising an isocyanate component; applying one of the first composition and the second composition onto a surface of the paperboard or paper media; applying the other of the first composition and the second composition onto the surface of the paperboard or paper media to form a treatment composition. In this embodiment, the isocyanate component is selected from the group of methylene diphenyl diisocyanate (MDI), polymethylene polyphenylisocyanate (PMDI), an isocyanate-terminated prepolymer, a carbodiimide polymer having unreacted isocyanate groups, and combinations thereof.

In another embodiment, the method comprises providing the paperboard or paper media; providing a capped polycarbodiimide, wherein the capped polycarbodiimide comprises the reaction product of a carbodiimide polymer having unreacted isocyanate groups and a reactive group selected from a monofunctional isocyanate, a monofunctional alcohol, a monofunctional amine and combinations thereof; and applying the capped polycarbodiimide as a coating onto a surface of the paperboard or paper media.

The present invention also provides for treated paperboards and paper media formed in accordance with any of the methods provided above.

Paperboards or paper media (i.e., unbleached kraft, solid bleached sulphate board or 100% recycled board) treated in accordance with any of the methods described above achieved increased strength under both dry and wet testing methodologies as compared with untreated paperboards and paper media of the same basis weight. In certain embodiments, the average wet tensile strength measurements of these treated paperboards yielded more than an 80% improvement as compared with untreated paperboards and paper media of the same basis weight. The present invention therefore allows the use of treated paperboards or paper media with reduced basis weight to achieve a similar and/or improved strength as compared to untreated paperboards or paper media of a higher basis weight. In addition, paperboards or paper media treated in accordance with the present method achieved increased barrier properties, such as increased water penetration prevention, as compared with untreated paperboard or paper media of the same basis weight.

DETAILED DESCRIPTION OF THE INVENTION

The subject invention provides a method for increasing the strength and barrier properties of paperboard or paper media. More specifically, the present invention provides methods for increasing the strength and barrier properties of paperboard or paper media by treating the paperboard or paper media with a composition designed to enhance the strength and barrier properties of the paperboard or paper media. This composition includes urethane groups and/or urea groups, and thus can generally be considered a treatment composition that may be a polyurethane composition and/or a polyurea composition.

The paperboard or paper media of the present invention include those that are commonly used in the packaging and printing industries to package and protect a wide variety of goods, such as, but not limited to, paper cartons used for packing 12 pack or 6 pack containers. Exemplary paperboard or paper media that may be used in the present invention include unbleached kraft, solid bleached sulphate board or 100% recycled board. The paperboard or paper media of the present invention is typically produced from cellulose by paper manufacturing techniques known in the paper industry, and thus typically includes fibers or other structure defining the paperboard or paper media. Still further, the paperboard or paper media is porous and has inherent moisture content, typically in the form of water vapor, present within these pores and which can adhere to the fibers or structure via hydrogen bonding.

In certain embodiments, the basis weight of the paperboard or paper media used in the present invention is 12 to 34 point, such as 14 to 26 point. The range of basis weight can depend on the type of paperboard or paper media, with beverage container boards being in the lower basis weight (such as 12-14 point) and corrugated paperboard being at the upper end (such as 30-32 point). Basis weight, as defined herein, is the weight in pounds of 1000 square feet of the respective paperboard or paper media (measured in "points"). Thus, a 14 point basis weight paperboard, for example, weighs approximately 14 pounds for a 1000 square foot sample, whereas a 26 point paperboard weighs 26 pounds for a 1000 square foot sample of the same thickness. Exemplary paperboard or paper media that may be used in the present invention include, but are not limited to, 12, 18 and 22 point unbleached kraft paper; 18 point coated recycle board; 12 and 14 point SBS board; 14 point uncoated recycle board; and 34 point liner board.

In a first method of the present invention, a treated paperboard or paper media is formed by the sequential application of two distinct compositions (a first composition and a second composition) on the surface of the paperboard or paper media (i.e., applying a first composition onto the surface of the paperboard or paper media followed by applying a second composition onto the surface of the paperboard or paper media such that the applied first composition reacts with the applied second composition) to form a treated paperboard or paper media. The reaction of the first composition with the second composition forms a treatment composition (i.e., a cured composition that may include urethane and/or urea and/or carbodiimide groups) on the paperboard or paper media, and hence forms the treated paperboard or paper media.

More specifically, in this first embodiment, the first method includes the steps of providing a first composition which comprises at least one component selected from a multifunctional alcohol, an amine, an amine derivative, a tin-based catalyst, and combinations thereof; providing a second composition comprising an isocyanate component; applying one of the first composition and the second composition onto a surface of the paperboard or paper media; and applying the other of the first composition and the second composition onto the surface of the paperboard or paper media to form a treatment composition, such as onto the one of the first composition and the second composition applied on the surface of the paperboard or paper media.

The term "applying," as used above, refers to any known conventional paperboard coating techniques, such as by the use of a draw down bar or rod, hand proofing, spray coating, etc. to form a coating on the surface. The term applying also includes the use of specific paper coating production equipment such as flexographic printers, off-set printers, gravure and the like. Prior to applying the first or second composition, the paperboard or paper media may be cleaned or otherwise prepared to remove loose fibers or debris.

In applications wherein a draw down bar is utilized for application, the applied coating of the first and second composition (applied in either order) is pressed within its surface and into the porous paperboard and/or paper media during or after its application (i.e., the applied coating of the isocyanate-terminated prepolymer or the applied coating of the polycarbodiimide having unreacted isocyanate groups infiltrates or otherwise impregnates the paperboard or paper media) and as such substantially coats the fibers or structure of the paperboard or paper media.

The at least one component of the first composition includes compounds which are each reactive with unreacted isocyanate groups from the isocyanate component of the second composition (described further below) to form polymers having urethane and/or urea groups and/or carbodiimide groups (i.e., polyurethanes and/or polyureas and/or polycarbodiimides).

The at least one component of the first composition may be a multifunctional alcohol, an amine, an amine derivative, a tin-based catalyst, and any combination thereof. Thus, for example, in certain embodiments, the at least one component of the first composition may include any two or three or all of a multifunctional alcohol, an amine, an amine derivative, and a tin-based catalyst.

Suitable multifunctional alcohol, amines and amine derivatives utilized as one of the at least one component in the first composition includes those having two or more active hydrogen species. Suitable multifunctional alcohol, amines and amine derivatives include, but are not limited to, dipropylene glycol, glycerol, triethanol amine, ethylene diamine, hexamethylene diamine and the like.

Suitable tin-based catalysts utilized as one of the at least one component in the first composition include, but are not limited to, tin carboxylate catalysts, tin mercaptide catalysts, tin thioglycolate catalysts, and any combination thereof. More specific exemplary tin-based catalysts include dimethyltin dineodecanoate, dioctyltin dineodecanoate, and dimethyltin mercaptide.

In addition, in embodiments wherein the at least one component of the first composition includes a tin-based catalyst, the first composition may also include low molecular weight chain extenders and crosslinkers. Low molecular weight chain extenders and crosslinkers include certain of the multifunctional alcohol, amines and amine derivatives described above and include, but are not limited to, dipropylene glycol, glycerol, triethanol amine, ethylene diamine, hexamethylene diamine and the like.

In certain embodiments, the first composition also includes water, in addition to the at least one component, and the first composition thus is a solution that includes both water and the at least one component. In embodiments of this first method including water, the concentration of the at least one component in water in the first composition is from greater than 10% to less than 100% based on the total combined weight of water and the at least one component, such as wherein the concentration of the at least one component in water is from 50% to less than 100% based on the total combined weight of water and the at least one component.

As noted above, the second composition includes an isocyanate component. The isocyanate component of the second composition typically has an average functionality of from about 1.5 to about 3.0, more typically from about 2.0 to about 2.8, and yet more typically about 2.7. The isocyanate component also typically has an NCO content of from about 30 to about 33, more typically from about 30.5 to about 32.5, and yet more typically about 31.5, wt. %.

Suitable isocyanate components for the second composition include, but are not limited to, methylene diphenyl diisocyanate (MDI), polymethylene polyphenylisocyanate (PMDI), an isocyanate-terminated prepolymer, a carbodiimide polymer having unreacted isocyanate groups (i.e., free (pendent) NCO groups), and any combinations thereof.

The isocyanate-terminated prepolymer, when present in the isocyanate component of the second composition, is generally the reaction product of an isocyanate and an active hydrogen-containing species and is formed by various methods understood by those skilled in the art or can be obtained commercially from a manufacturer, a supplier, etc.

In certain embodiments, the active hydrogen-containing species in the isocyanate-terminated prepolymer of the second composition is a polyol or a polyamine.

In still further embodiments, the active hydrogen-containing species has a weight average molecular weight (Mw) ranging from 76 to 5,500 g/mol, as measured by gel permeation chromatography (GPC) or nuclear magnetic resonance (NMR) previously calibrated using a calibration curve based on mono-dispersed polystyrene standards. For this invention, all weight average molecular weights described herein were measured by gel permeation chromatography (GPC) or nuclear magnetic resonance (NMR) previously calibrated using a calibration curve based on mono-dispersed polystyrene standards.

With regard to the isocyanate used to form the isocyanate-terminated prepolymer in this first method, the isocyanate may include one or more isocyanate (NCO) functional groups, typically at least two NCO functional groups. Suitable isocyanates, for purposes of the present invention for use in forming the isocyanate-terminated prepolymer include, but are not limited to, conventional aliphatic, cycloaliphatic, aryl and aromatic isocyanates.

In certain embodiments, the isocyanate of the isocyanate-terminated prepolymer of the second composition is selected from the group of methylene diphenyl diisocyanate (also sometimes referred to as diphenylmethane diisocyanate, MDI, or monomeric MDI), polymethylene polyphenyl diisocyanate (also sometimes referred to as polymeric diphenylmethane diisocyanate, polymeric MDI or PMDI), and combinations thereof. MDI exists in three isomers (2,2'-MDI, 2,4'-MDI, and 4,4'-MDI) however, the 4,4' isomer (sometimes referred to as Pure MDI) is most widely used. For the purposes of the present invention, the term "MDI" refers to all three isomers unless otherwise noted. In these embodiments, MDI and PMDI are desirable for use over toluene diisocyanate (TDI) due to their lower reactivity, which allows further penetration/impregnation of the isocyanate-terminated prepolymer into the paperboard or paper media after application and prior to substantial curing. In addition, MDI or PMDI allows for the formation of more flexible treated paperboards, as compared to the use of TDI, due to the methylene bridges contained within these structures. Still further, MDI and PMDI have lower vapor pressure than TDI, allowing safer handling prior to and during application.

If employed, the polyol used as an active hydrogen species in the second composition includes one or more hydroxyl (OH) functional groups, typically at least two OH functional groups. The polyol can be any type of polyol known in the art. The polyol can be a non-ethoxylated, or ethoxylated, polyol or short chain, low molecular weight polyol having one or more OH functional groups. The polyol is typically selected from the group of ethylene glycol, diethylene glycol, propylene glycol, dipropylene glycol, butanediol, glycerol, trimethylolpropane, triethanolamine, pentaerythritol, sorbitol, and combinations thereof. Other suitable polyols, for purposes of the present invention, are described below with description of an additional, optional, component, a supplemental polyol.

The polyol can be used in various amounts relative to the isocyanate in the isocyanate-terminated prepolymer, as long as an excess of NCO functional groups relative to OH functional groups are present prior to reaction such that the isocyanate-terminated prepolymer, after formation, includes pendent (free) NCO functional groups for subsequent reaction. The isocyanate-terminated prepolymer typically has an NCO content greater than 0 to about 48 wt %, such as from 18 to 28 wt %, such as from 20 to 25 wt. %. When the free NCO content in the isocyanate-terminated prepolymer is not met (i.e., is about 0%) the strength properties of the treated paperboard rely upon the applied polymer and not on its ability to react with moisture or free hydroxyl groups in the cellulose of the paperboard or paper media to form a network after application. NCO content can be determined as the amount of isocyanate which combines with 1 equivalent of n-dibutylamine, which is measure in terms of weight percent.

Particularly suitable polyols for use in the isocyanate-terminated prepolymer of the second composition of this first method include polyether polyols and/or polyester polyols.

Suitable polyether polyols for use in the isocyanate prepolymer of the second composition of this first method include, but are not limited to, products obtained by the polymerization of a cyclic oxide, for example ethylene oxide (EO), propylene oxide (PO), butylene oxide (BO), or tetrahydrofuran in the presence of polyfunctional initiators. Suitable initiator compounds contain a plurality of active hydrogen atoms, and include water, butanediol, ethylene glycol, propylene glycol (PG), diethylene glycol, triethylene glycol, dipropylene glycol, ethanolamine, diethanolamine, triethanolamine, toluene diamine, diethyl toluene diamine, phenyl diamine, diphenylmethane diamine, ethylene diamine, cyclohexane diamine, cyclohexane dimethanol, resorcinol, bisphenol A, glycerol, trimethylolpropane, 1,2,6-hexanetriol, pentaerythritol, and combinations thereof.

Other suitable polyether polyols include polyether diols and triols, such as polyoxypropylene diols and triols and poly(oxyethylene-oxypropylene)diols and triols obtained by the simultaneous or sequential addition of ethylene and propylene oxides to di- or tri-functional initiators. Copolymers having oxyethylene contents of from about 5 to about 90% by weight, based on the weight of the polyol component, of which the polyols may be block copolymers, random/block copolymers or random copolymers, can also be used. Yet other suitable polyether polyols include polytetramethylene ether glycols obtained by the polymerization of tetrahydrofuran.

Particularly suitable polyether polyols for use in the isocyanate-terminated prepolymer of this first method include those based on a totally heteric (or random) EO, PO structure, or those having heteric, but uniform blocks of EO and PO, e.g. blocks comprising EO and blocks comprising PO. As yet another suitable example, the polyether polyol used in this first method can have heteric blocks and uniform blocks of EO and PO, e.g. blocks comprising all EO and blocks comprising random EO, PO.

In certain of these embodiments, the polyether polyols for use in this first method have a weight average molecular weight (Mw) ranging from 76 to 5,500 g/mol, as measured by gel permeation chromatography (GPC) or nuclear magnetic resonance (NMR) previously calibrated using a calibration curve based on mono-dispersed polystyrene standards.

Suitable polyester polyols for use in the isocyanate-terminated prepolymer of this first method include hydroxyl-terminated reaction products of polyhydric alcohols, such as ethylene glycol, propylene glycol, diethylene glycol, 1,4-butanediol, neopentylglycol, 1,6-hexanediol, cyclohexane dimethanol, glycerol, trimethylolpropane, pentaerythritol or polyether polyols or mixtures of such polyhydric alcohols, and polycarboxylic acids, especially dicarboxylic acids or their ester-forming derivatives, for example succinic, glutaric and adipic acids or their dimethyl esters sebacic acid, phthalic anhydride, tetrachlorophthalic anhydride or dimethyl terephthalate or mixtures thereof. Polyester polyols obtained by the polymerization of lactones, e.g. caprolactone, in conjunction with a polyol, or of hydroxy carboxylic acids, e.g. hydroxy caproic acid, may also be used. Suitable polyester polyols are commercially available from BASF Corporation of Florham Park, N.J. under the trade names of PLURACOL® and PLURONIC®.

In certain of these embodiments, the polyester polyols for use in the second composition of this first method have a weight average molecular weight ($M_w$) ranging from 76 to 5,500 g/mol, as measured by gel permeation chromatography (GPC) or nuclear magnetic resonance (NMR) previously calibrated using a calibration curve based on mono-dispersed polystyrene standards.

If employed to form the isocyanate-terminated prepolymer of the second composition in this first method, the polyamine includes one or more amine functional groups, typically at least two amine functional groups. The polyamine can be any type of polyamine known in the art. The polyamine is typically selected from the group of ethylene diamine, toluene diamine, diaminodiphenylmethane and polymethylene polyphenylene polyamines, aminoalcohols, and combinations thereof. Examples of suitable aminoalcohols include ethanolamine, diethanolamine, triethanolamine, and combinations thereof.

In certain of these embodiments, the polyamines for use in forming the isocyanate prepolymer of the second composition in this first method have a weight average molecular weight (Mw) ranging from 76 to 5,500 g/mol, such as from 76 to 145 g/mol, as measured by gel permeation chromatography (GPC) or nuclear magnetic resonance (NMR) previously calibrated using a calibration curve based on mono-dispersed polystyrene standards.

The polyamine can be used in various amounts relative to the isocyanate, as long as an excess of NCO functional groups relative to amine functional groups are present prior to reaction such that the isocyanate-terminated prepolymer, after formation, includes NCO functional groups for subsequent reaction. The NCO content of the isocyanate-terminated prepolymer is as described and exemplified above.

It is to be appreciated that the isocyanate-terminated prepolymer used in the second composition of this first method of the present invention may be formed from a combination of two or more of the aforementioned polyols (polyester polyols, polyether polyols and combinations thereof) and/or two or more of the aforementioned polyamines (i.e., the isocyanate-terminated prepolymer may include two or more chemically distinct active hydrogen-containing species). Typically, the isocyanate-terminated prepolymer is a reaction product of the isocyanate and at least one polyol such that the isocyanate-terminated prepolymer includes urethane linkages and NCO functional groups after formation.

For example, in certain embodiments, a combination of two or more polyether polyols can be used, with each two or more polyether polyols having the same or a different weight average molecular weight within the range of 76 to 5,500 g/mol described above. Thus, for example, the polyether polyol used in forming the isocyanate-terminated prepolymer of the second composition of this first method may include a first polyether polyol having a weight average molecular weight ranging from 1,800 to 2,000 g/mol and a second polyether polyol having a weight average molecular weight ranging from 4,700 to 4,900 g/mol.

Similarly, in certain further embodiments, a combination of two or more polyester polyols can be used to form the isocyanate-terminated prepolymer, with each two or more polyester polyols having the same or a different weight average molecular weight within the range of 76 to 5,500 g/mol described above. Thus, for example, the polyester polyol used in this first method may include a first polyester polyol having a weight average molecular weight ranging from 2,200 to 2,400 g/mol and a second polyether polyol having a weight average molecular weight ranging from 4,800 to 5,000 g/mol.

Still further, in certain embodiments, a mixture of two or more different types of active hydrogen containing species (i.e., a mixture of two or all three of polyether polyols, polyester polyols and polyamines, including more than one polyether polyols, polyester polyols or polyamines in combination with other types of active hydrogen containing species as described above) can also be utilized to form the isocyanate-terminated prepolymer.

In certain embodiments, the isocyanate-terminated prepolymer of the second composition comprises a blend of PMDI and quasi-prepolymers of 4,4'-methyldiphenyldiisocyanate. Specific examples of suitable isocyanate-terminated prepolymers, for purposes of the present invention, are commercially available from BASF Corporation of Florham Park, N.J., under the trademark LUPRANATE®, such as LUPRANATE® MP102. It is to be appreciated that the system can include a combination of two or more of the aforementioned isocyanate-terminated prepolymers.

In certain embodiments, the applied coating of the second composition comprises a reaction product of (1) an active hydrogen-containing species and (2) methylene diphenyl diisocyanate (MDI) and/or polymethylene polyphenyl diisocyanate (PMDI). In certain embodiments, the active hydrogen-containing species is any one or more of the polyether polyols, the polyester polyols and/or the polyamines as described above.

The carbodiimide polymer, or polycarbodiimide, for use in the isocyanate component of the second composition of this first method include repeating structuring units represented by $—(N{=}C{=}N)_n—$, where subscript n designates the number of times this structural unit is repeated in the polycarbodiimides. Polycarbodiimides used in this invention are generally formed by treating an isocyanate component, typically an organic isocyanate, with suitable carbodiimidization catalysts.

With regard to the isocyanate component used to form the polycarbodiimide in this second method, the isocyanate component includes one or more isocyanate (NCO) functional groups, typically at least two NCO functional groups. Particularly suitable isocyanate components are diisocyanates (isocyanates having an average of two NCO functional groups per molecule) Suitable isocyanate component include, but are not limited to, conventional aliphatic, cycloaliphatic, aryl and aromatic isocyanates and may include monomeric or polymeric isocyanates.

Exemplary diisocyanates that may be used in forming the polycarbodiimide include, but are not limited to: MDI (in any the three isomers (2,2'-MDI, 2,4'-MDI, and 4,4'-MDI); m-phenylene diisocyanate; 2,4-toluene diisocyanate; 2,6-toluene diisocyanate; hexamethylene diisocyanate; 1,4-phenylene diisocyanate; tetramethylene diisocyanate; cyclohexane-1,4-diisocyanate; hexahydrotoluene diisocyanate; methylenediisocyanate; 2,6-diisopropylphenyl isocyanate; m-xylylene diisocyanate; dodecyl isocyanate; 3,3'-dichloro-4,4'-diisocyanato-1,1'-biphenyl; 1,6-diisocyanato-2,2,4-trimethylhexane; 3,3'-dimethoxy-4,4'-biphenylene diisocyanate; 2,2-diisocyanatopropane; 1,3-diisocyanatopropane; 1,4-diisocyanatobutane; 1,5-diisocyanatopentane; 1,6-diisocyanatohexane; 2,3-diisocyanatotoluene; 2,4-diisocyanatotoluene; 2,5-diisocyanatotoluene; 2,6-diisocyanatotoluene; isophorone diisocyanate; hydrogenated methylene bis(phenylisocyanate); naphthalene-1,5-diisocyanate; 1-methoxyphenyl-2,4-diisocyanate; 1,4-diisocyanatobutane; 4,4'-biphenylene diisocyanate; 3,3'-dimethyldiphenylmethane-4, 4'-diisocyanate; 4,4',4"-triphenylmethane triisocyanate; toluene-2,4,6-triisocyanate; 4,4'-dimethyldiphenylmethane-2,2',5,5'-tetraisocyanate; polymethylene polyphenylene polyisocyanate; or a mixture of any two or more thereof. In a preferred embodiment, the diisocyanate is 2,4-toluene diisocyanate, 2,6-toluene diisocyanate, or a mixture of 2,4- and 2,6-toluene diisocyanate. In one embodiment, the diisocyanate includes 100% 2,4-toluene diisocyanate. In another embodiment, the diisocyanate includes about 80% 2,4-toluene diisocyanate and about 20% 2,6-toluene diisocyanate. In another embodiment, the diisocyanate includes about 65% 2,4-toluene diisocyanate and about 35% 2,6-toluene diisocyanate.

In certain embodiments, the isocyanate component for forming the polycarbodiimide comprises MDI (in any the three isomers (2,2'-MDI, 2,4'-MDI, and 4,4'-MDI). Alternatively, the isocyanate component may comprise a blend of two or all three of these three MDI isomers, i.e., the isocyanate component may comprise at least two of 2,2'-MDI, 2,4'-MDI, and 4,4'-MDI.

In certain other embodiments, the isocyanate component for forming the polycarbodiimide comprises toluene diisocyanate (TDI). The isocyanate component may comprise either isomer of toluene diisocyanate (TDI), i.e., the isocyanate component may comprise 2,4-toluene diisocyanate (2,4-TDI) or 2,6-toluene diisocyanate (2,6-TDI). Alternatively, the isocyanate component may comprise a blend of these isomers, i.e., the isocyanate component may comprise both 2,4-toluene diisocyanate (2,4-TDI) and 2,6-toluene diisocyanate (2,6-TDI). One specific example of a commercially available isocyanate component suitable for the purposes of the present invention is Lupranate® T-80, which is commercially available from BASF Corporation of Florham Park, N.J. Notably, Lupranate® T-80 comprises a blend of 2,4-toluene diisocyanate (2,4-TDI) and 2,6-toluene diisocyanate (2,6-TDI). In certain embodiments, the isocyanate component consists essentially of, or consists of, TDI. Generally, the isocyanate component comprises TDI in an amount of from greater than 95, alternatively greater than 96, alternatively greater than 97, alternatively greater than 98, alternatively greater than 99, percent by weight based on the total weight of isocyanate present in the isocyanate component.

The carbodiimidization catalyst may be any type of carbodiimidization catalyst known to those skilled in the art for producing a polycarbodiimide. Generally, the carbodiimidization catalyst is selected from the group of tertiary amides, basic metal compounds, carboxylic acid metal salts and/or non-basic organo-metallic compounds. In certain embodiments, the carbodiimidization catalyst comprises a phosphorus compound.

Specific examples of phosphorus compounds suitable for the purposes of the carbodiimidization catalyst include, but are not limited to, phospholene oxides such as 3-methyl-1-phenyl-2-phospholene oxide, 1-phenyl-2-phospholen-1-oxide, 3-methy-1-2-phospholen-1-oxide, 1-ethyl-2-phospholen-1-oxide, 3-methyl-1-phenyl-2-phospholen-1-oxide, and 3-phospholene isomers thereof. A particularly suitable phospholene oxide is 3-methyl-1-phenyl-2-phospholene oxide. For illustrative purposes only, 3-methyl-1-phenyl-2-phospholene oxide is represented by the following structure:

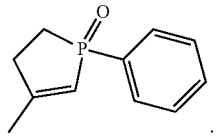

Additional examples of phosphorous compounds suitable for the purposes of the carbodiimidization catalyst include, but are not limited to, phosphates, diaza- and oxaza phospholenes and phosphorinanes. Specific examples of such phosphorous compounds include, but are not limited to, phosphate esters and other phosphates such as trimethyl phosphate, triethyl phosphate, tributyl phosphate, tri-2-ethylhexyl phosphate, tributoxyethyl phosphate, trioleyl phosphate, triphenyl phosphate, tricresyl phosphate, trixylenyl phosphate, cresyl diphenyl phosphate, xylenyl diphenyl phosphate, 2-ethylhexyldiphenyl phosphate, and the like; acidic phosphates such as methyl acid phosphate, ethyl acid phosphate, isopropyl acid phosphate, butyl acid phosphate, 2-ethylhexyl acid phosphate, isodecyl acid phosphate, lauryl acid phosphate, isotridecyl acid phosphate, myristyl acid phosphate, isostearyl acid phosphate, oleyl acid phosphate, and the like; tertiary phosphites such as triphenyl phosphite, tri(p-cresyl) phosphite, tris(nonylphenyl) phosphite, triisooctyl phosphite, diphenyisodecyl phosphite, phenyldiisodecyl phosphite, triisodecyl phosphite, tristearyl phosphite, trioleyl phosphite, and the like; secondary phosphites such as di-2-ethylhexyl hydrogen phosphite, dilauryl hydrogen phosphite, dioleyl hydrogen phosphite, and the like; and phosphine oxides, such as triethylphosphine oxide, tributylphosphine oxide, triphenylphosphine oxide, tris(chloromethyl)phosphine oxide, tris(chloromethyl)phosphine oxide, and the like. Carbodiimidization catalysts comprising phosphate esters and methods for their preparation are described in U.S. Pat. No. 3,056,835, which is hereby incorporated by reference in its entirety.

Yet further examples the carbodiimidization catalyst include, but are not limited to, 1-phenyl-3-methyl phospholene oxide, 1-benzyl-3-methyl phospholene oxide, 1-ethyl-3-methyl phospholene oxide, 1-phenyl-3-methyl phospholene dichloride, 1-benzyl-3-methyl phospholene dichloride, 1-ethyl-3-methyl phospholene dichloride, 1-phenyl-3-methyl phospholene sulphide, 1-phenyl-3-methyl phospholene sulphide, 1-benzyl-3-methyl phospholene sulphide, 1-ethyl-3-methyl phospholene sulphide, 1-phenyl-1-phenylimino-3-methyl phospholene oxide, 1-benzyl-1-phenylimino-3-methyl phospholene oxide 1-ethyl-1-phenylimino-3-methyl phospholene oxide, 1-phenyl phospholidine, 1-benzyl phospholidine, 1-ethyl phospholidine, and 1-phenyl-3-methyl phospholene oxide.

The carbodiimidization catalyst may alternatively comprise diaza and oxaza phospholenes and phosphorinanes. Diaza and oxaza phospholenes and phosphorinanes and methods for their preparation are described in U.S. Pat. No. 3,522,303, which is hereby incorporated by reference in its entirety. Specific diaza- and oxaza phospholenes and phosphorinanes include, but are not limited to, 2-ethyl-1,3-dimethyl-1,3,2-diazaphospholane-2-oxide; 2-chloro methyl-1,3-dimethyl-1,3,2-diazaphospholane-2-oxide; 2-trichloro methyl-1,3-dimethyl-1,3,2-diazaphospholane-2-oxide; 2-phenyl-1,3-dimethyl-1,3,2-diazaphospholane-2-oxide; 2-phenyl-1,3-dimethyl-1,3,2-diaza-phosphorinane-2-oxide; 2-benzyl-1,3-dimethyl-1,3,2-diazaphospholane-2-oxide; 2-allyl-1,3-dimethyl-1,3,2-diazaphospholane-2-oxide; 2-bromomethyl-1,3-dimethyl-1,3,2-diazaphospholane-2-oxide; 2-cyclohexyl-1,3-dimethyl-1,3,2-diazaphospholane-2-oxide; 2-cyclohexyl-1,3-dimethyl-1,3,2-diaphospholane-2-oxide; 2-(2-ethoxyethyl1,3-dimethyl-1,3,2-diazaphospholane-2-oxide; and 2-naphthyl-1,3-dimethyl-1,3,2-diazaphospholane-2-oxide, triethyl phosphate, hexamethyl phosphoramide, and the like.

The carbodiimidization catalyst may comprise a triaryl arsine. Triaryl arsines and methods for their preparation are described in U.S. Pat. No. 3,406,198, which is hereby incorporated by reference in its entirety. Specific examples of triaryl arsines include, but are not limited to, triphenylarsine, tris(p-tolyl)arsine, tris(p-methoxyphenyl)arsine, tris(p-ethoxyphenyl)arsine, tris(p-chlorophenyl)arsine, tris(p-fluorophenyl)arsine, tris(2,5-xylyl)arsine, tris(p-cyanophenyl) arsine, tris(1-naphthyl)arsine, tris(p-methylmercaptophenyl) arsine, tris(p-biphenylyl)arsine, p-chlorophenyl bis(ptolyl) arsine, phenyl(p-chlorophenyl)(p-bromophenyl)arsine, and the like. Additional arsine compounds are described in U.S. Pat. No. 4,143,063, which is hereby incorporated by reference in its entirety. Specific examples of such arsine compounds include, but are not limited to, triphenylarsine oxide, triethylarsine oxide, polymer bound arsine oxide, and the like.

Further, the carbodiimidization catalyst may comprise metallic derivatives of acetlyacetone. Metallic derivatives of acetlyacetone and methods are described in U.S. Pat. No. 3,152,131, which is hereby incorporated by reference in its entirety. Specific examples of metallic derivatives of acetlyacetone include, but are not limited to, metallic derivatives of acetylacetone such as the beryllium, aluminum, zirconium, chromium, and iron derivatives.

Additional examples of the carbodiimidization catalyst include metal complexes derived from a d-group transition element and π-bonding ligand selected from the group consisting of carbon monoxide, nitric oxide, hydrocarbylisocyanides, trihydrocarbylphosphine, trihydfrocarbylarsine, trihydrocarbylstilbine, and dihydrocarbylsulfide wherein hydrocarbyl in each instance contains from 1 to 12 carbon atoms, inclusive, provided that at least one of the π-bonding ligands in the complex is carbon monoxide or hydrocarbylisocyanide. Such metal complexes and methods for preparation are described in U.S. Pat. No. 3,406,197, which is hereby incorporated by reference in its entirety. Specific examples of metal complexes include, but are not limited to, iron pentacarbonyl, di-iron pentacarbonyl, tungsten hexacarbonyl, molybdenum hexacarbonyl, chromium hexacarbonyl, dimanganese decacarbonyl, nickel tetracarbonyl, ruthenium pentacarbonyl, the complex of iron tetracarbonyl: methylisocyanide, and the like.

The carbodiimidization catalyst may comprise organotin compounds. Specific examples of organotin compounds include, but are not limited to, dibutytin dilaurate, dibutyltin diacetate, dibutyltin di(2-ethylhexanoate), dioctyltin dilaurate, dibutylin maleate, di(n-octyl)tin maleate, bis(dibutylacetoxytin) oxide, bis(dibutyllauroyloxytin) oxide, dibutyltin dibutoxide, dibutyltin dimethoxide, dibutyltin disalicilate, dibutyltin bis(isooctylmaleate), dibutyltin bis (isopropylmaleate), dibutyltin oxide, tributyltin acetate, tributyltin isopropyl succinate, tributyltin linoleate, tributyltin nicotinate, dimethyltin dilaurate, dimethyltin oxide, diotyltin oxide, bis(tributyltin) oxide, diphenyltin oxide, triphenyltin acetate, tri-n-propyltin acetate, tri-n-propyltin laurate and bis(tri-n-propyltin) oxide, dibutyltin dilauryl mercaptide, dibutyltin bis(isooctylmercaptoacetate), bis(triphenyltin)oxide, stannous oxalate, stannous oleate, stannous naphthenate, stannous acetate, stannous butyrate, stannous 2-ethylhexanoate, stannous laurate, stannous palmitate, stannous stearate, and the like. Typical organotin compounds include, but are not limited to, stannous oxalate, stannous oleate and stannous 2-ethylhexanoate, dibutyltin diacetate, dibutyltin dilaurate, dibutyltin dilaurylmercaptide, dibutyltin bis(isooctylmercaptoacetate), dibutyltin oxide, bis (triphenyltin) oxide, and bis(tri-n-butyltin) oxide.

Further, the carbodiimidization catalyst may comprise various organic and metal carbene complexes, titanium (IV) complexes, copper (I) and/or copper (II) complexes.

The polycarbodiimide formed from the step of polymerizing the isocyanate component typically has a number average molecular weight (as measured using NMR or GPC) of from about 76 to about 10,000, more typically from about 5,000 to about 10,000, such as from 7,500 to 9,000, g/mol (Daltons).

The step of polymerizing the isocyanate component for use in forming the polycarbodiimide is typically carried out in an inert atmosphere, i.e., an atmosphere substantially free from oxygen. Any inert atmosphere known in the art may be utilized during the step of polymerizing the isocyanate component. Typically, the inert atmosphere comprises an inert gas, such as nitrogen, argon, and helium, etc.

As readily understood in the art, carbon dioxide gas is released during the step of polymerizing the isocyanate component. Specifically, carbon dioxide is a by-product formed when —N═C═O groups present in the isocyanate component react with one another to form —N═C═N— linkages.

A reaction mechanism illustrative of the polymerization of the isocyanate component with the carbodiimidization catalyst is set forth below. In the reaction mechanism below, the isocyanate component comprises 2,4-toluene diisocyanate (2,4-TDI) and 2,6-toluene diisocyanate (2,6-TDI), which are reacted in the presence of a carbodiimidization catalyst to produce various polycarbodiimides. In the polycarbodiimides of the reaction mechanism below, n is an integer dependent upon the molecular weight of the particular polycarbodiimide.

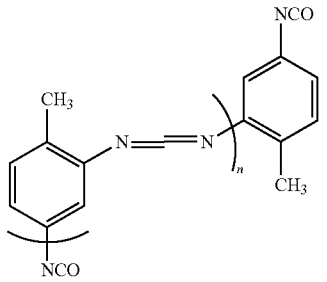

-continued

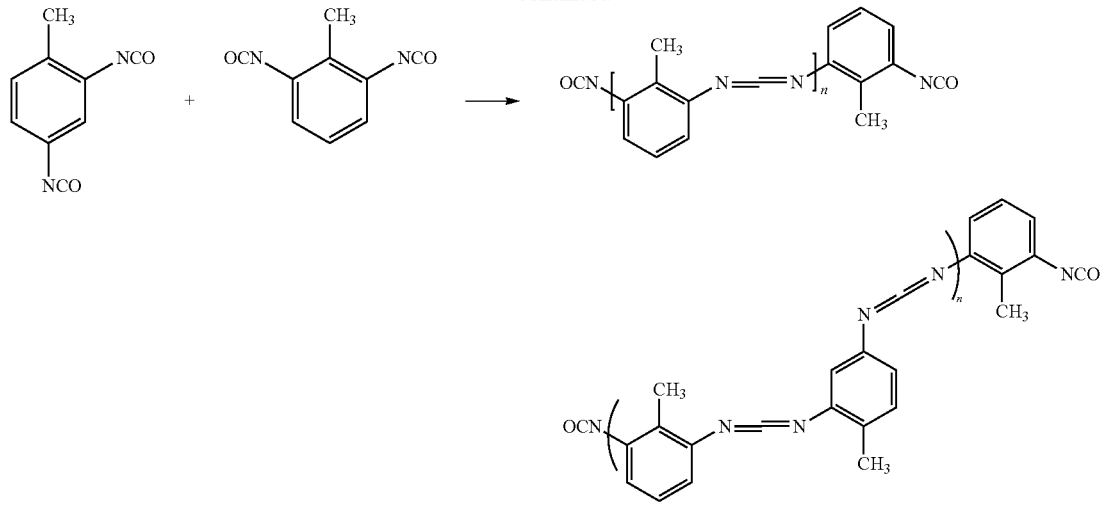

In this first embodiment, the method for application of isocyanate component may be done by any known conventional paperboard coating techniques, such as by the use of a draw down bar, spray coating, etc. to form a coating. Prior to applying the first and second compositions, the paperboard or paper media may be cleaned or otherwise prepared to remove loose fibers or debris.

In applications wherein a draw down bar is utilized for application, the applied coating of the first and second composition are pressed within its surface and into the porous paperboard and/or paper media (i.e., the applied first and second composition infiltrates or otherwise impregnates the paperboard or paper media) and as such substantially coats the fibers or structure of the paperboard or paper media.

Upon application of the second of the two applied compositions (the application of one of the first or second composition followed by the application of the other of the first or second composition) to form the treatment composition, the pendent or free NCO-groups of the isocyanate component react with water (if present) in the isocyanate reactive component and with any moisture present in the paperboard or paper media to ultimately form urea groups in the treatment composition on the paperboard or paper media. In addition, the pendent or free NCO-groups of the applied isocyanate component (as the other of the first or second composition) also react with free hydroxyl groups present in the paperboard or paper media to form urethane groups in the treatment composition on the paperboard or paper media. Still further, the pendent or free NCO-groups of the applied isocyanate component react with the active hydrogens found in the multifunctional alcohol, the amine, or the amine derivative of the isocyanate reactive component (if present) to form further urethane or urea groups. The tin catalyst present in the isocyanate reactive component acts to catalyze these reactions and can also function to catalyze the self polymerization reaction of isocyanate component to form carbodiimide groups in the treatment composition when the tin catalyst is the only component of the isocyanate reactive component. Thus the treatment composition, as defined in this embodiment, refers to both the mixture of the first and second compositions prior to any reaction occurring and also refers to the subsequent reaction of the first and second composition to form the urea, urethane and/or carbodiimide groups as described above.

After complete or substantially complete reaction of the first composition with the second composition in the treatment composition, wherein all, or substantially all, of the free NCO-groups of the isocyanate component are reacted with water and/or with active hydrogen groups from the isocyanate reactive component or free hydroxyl groups otherwise present in the paperboard or paper media or with moisture present in the paperboard or paper media, the resultant cured composition of the treatment composition has a weight average molecular weight ranging from 174 to 7000 g/mol (Daltons), as measured by NMR or GPC.

To facilitate or speed up the reaction process, in certain embodiments, additional catalysts or heat may be utilized to ensure that substantially all of the free NCO groups present in the treatment composition are reacted. Suitable additional catalysts that may be added include, but are not limited to, amine catalysts (such as TEDA), tin-based catalysts, organometallics and the like. In certain embodiments, the treated paperboard or paper media may also be heated to a temperature between 60 and 90° C., such as 60 to 80° C. Still further, the heating may occur in a chamber wherein the humidity is set to 80 to 100% relative humidity.

In another alternative embodiment of the present invention, the method for treating the paperboard or paper media is accomplished by forming a treated paperboard or paper media by applying a capped polycarbodiimide as a coating onto the paperboard or paper media.

In various embodiments, the capped polycarbodiimide of this method has the following formula:

$$R^2—N=C=N—[R^1—N=C=N]_n—R^2$$

wherein each $R^1$ is independently an alkyl, cycloalkyl, aromatic, heterocyclic, or heteroaryl group, each $R^2$ is independently an alkyl, cycloalkyl, aromatic, heterocyclic, or heteroaryl group, and n is an integer from 1 to 100.

In the capped polycarbodiimide of this method, $R^1$ is a linking group formed from a diisocyanate, and $R^2$ is an end cap formed from a monoisocyanate. In various embodiments, the linking group is alkyl, cycloalkyl, aromatic, heterocyclic, or heteroaryl. Illustrative examples of $R^1$ and $R^2$ include, but are not limited to, methylene, ethylene, propylene, isopropylene, butylene, pentylene, hexylene, heptylene, octylene, nonylene, decalinylene, dodecylene, 1,2-cyclohexylene, 1,3-cyclohexylene, 1,4-cyclohexylene, 1,2-phenylene, 1,3-phenylene, 1,4-phenylene, a tolyl, or a xylyl.

In some of these embodiments, $R^2$ may be a $C_1$-$C_{12}$ alkyl, $C_1$-$C_{12}$ cycloalkyl, a $C_6$-$C_{12}$ aromatic, a $C_6$-$C_{12}$ heterocyclic, or a $C_6$-$C_{12}$ heteroaryl. For example, $R^2$ may be a methyl, an ethyl, a propyl isopropyl, a butyl, a pentyl hexyl, a heptyl, an octyl, a nonyl, a decalinyl, a dodecyl, a cyclohexyl, a phenyl, or a tolyl group. In some preferred embodiments, $R^2$ is an aromatic group. For example, in some embodiments, the monoisocyanate is an aromatic isocyanate is 1,3-phenylene, 1,4-phenylene, a tolyl, or a xylyl group.

In some of these embodiments, $R^1$ may be a $C_1$-$C_{12}$ alkyl, $C_1$-$C_{12}$ cycloalkyl, a $C_6$-$C_{12}$ aromatic, a $C_6$-$C_{12}$ heterocyclic, or a $C_6$-$C_{12}$ heteroaryl. For example, $R^1$ may be a methylene, an ethylene, a propylene, an isopropylene, a butylene, a pentylene, a hexylene, a heptylene, an octylene, a nonylene, a decalinylene, a dodecylene, a 1,2-cyclohexylene, a 1,3-cyclohexylene, a 1,4-cyclohexylene, a 1,2-phenylene, a 1,3-phenylene, a 1,4-phenylene, or an tolyl group. In some preferred embodiments, $R^1$ is an arylene group. For example, in some embodiments, $R^1$ is 1,3-phenylene, 1,4-phenylene, a tolyl, or a xylyl group.

In one particular embodiment, $R^2$ is phenyl or tolyl group and $R^1$ is 1,2-phenylene, 1,3-phenylene, 1,4-phenylene, or tolyl group.

In any of the above embodiments, the capped polycarbodiimide of this method may have a weight average molecular weight of from about 4,500 to about 30,000, alternatively from about 5,500 to about 30,000, alternatively from about 12,000 about 18,000, alternatively from about 12,000 to about 14,000, g/mol (Daltons).

Furthermore, method for treating the paperboard or paper media of this method may also include the step of forming the capped polycarbodiimide prior to its application. More specifically, the capped polycarbodiimide may be by a process such that it lacks residual isocyanate (NCO) groups, or at least has a very high percentage of —N═C═N— linkages in comparison to residual NCO groups. The capped polycarbodiimide has less than about 0.25, alternatively less than about 0.1, alternatively less than about 0.075, wt. % free NCO groups. In some embodiments, the capped polycarbodiimide has no free NCO groups, e.g. in some embodiments any remaining NCO groups are so few as to be undetectable by infra-red spectroscopy.

In certain embodiments, the capped carbodiimide is formed as the reaction product of a carbodiimide polymer having unreacted NCO groups, such as but not limited to the carbodiimide polymers as described in the second and third methods above, with a reactive species.

In certain embodiments, the reactive species is a monofunctional isocyanate. In certain other embodiments, the reactive species is a monofunctional alcohol group. In still further embodiments, the reactive species is a monofunctional amine.

In still further embodiments, the capped polycarbodiimide may be prepared according to the reaction described in Scheme 1 below:

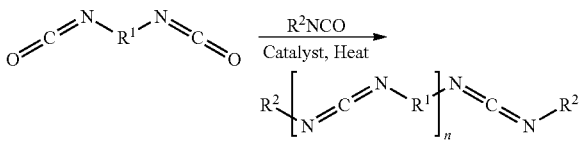

In the reaction described in Scheme 1, the polycarbodiimide is prepared in process that includes combining a diisocyanate, an oxygen scavenger, a monoisocyanate, and a carbodiimidization catalyst to form a reaction mixture. The reaction mixture is then heated to a temperature and for a time sufficient to form the polycarbodiimide. The process produces a polycarbodiimide having 0.25 wt. % or less, alternatively 0.1 wt. % or less, of free isocyanate groups (i.e., the polycarbodiimide is a capped polycarbodiimide). Further, steps of combining and heating are conducted in the absence of a solvent.

As readily understood in the art, carbon dioxide gas is released during the step of polymerizing the isocyanate component. Specifically, carbon dioxide is a by-product formed when isocyanate (—N═C═O) groups present in the isocyanate component react with one another to form carbodiimide linkages (—N═C═N—).

During the process of forming the capped polycarbodiimide as in Scheme 1, the diisocyanate, the monoisocyanate, the oxygen scavenger, and the carbodiimidization catalyst may be added to a reactor all together or in any order. In one embodiment, the diisocyanate, the monoisocyanate, and the oxygen scavenger are combined and heated prior to addition of the carbodiimidization catalyst. Once formed, the reaction mixture may be heated to a temperature of from about 30 to about 200, alternatively from about 60 to about 120, alternatively from about 100 to about 110, ° C. for a time of from about 2 hours to about 48 hours, alternatively from about 4 hours to about 20 hours, alternatively from about 4 hours to about 14 hours.

In Scheme 1, $R^1$ is a linking group, which in the diisocyanate is the group on which the isocyanates are located. Also included in the reaction mixture is a monoisocyanate ($R^2NCO$) that results in the end groups capping the polycarbodiimide.

$R^1$ and $R^2$ may individually be alkyl, cycloalkyl, aromatic, heterocyclic, or heteroaryl. In some embodiments of the above compounds, $R^1$ and $R^2$ may individually be $C_1$-$C_{12}$ alkyl, $C_1$-$C_{12}$ cycloalkyl, a $C_6$-$C_{12}$ aromatic, a $C_6$-$C_{12}$ heterocyclic, or a C6-C12 heteroaryl group. For example, $R^1$ and $R^2$ may individually be a methylene, ethylene, propylene, isopropylene, butylene, pentylene, hexylene, heptylene, octylene, nonylene, decalinylene, dodecylene, 1,2-cyclohexylene, 1,3-cyclohexylene, 1,4-cyclohexylene, 1,2-phenylene, 1,3-phenylene, 1,4-phenylene, tolyl, 1,5-naphtyl, isophorone, or 1,3-xylyl. In some preferred embodiments, R1 is an aryl group. For example, R1 may preferably be phenyl, tolyl, or xylyl. In other preferred embodiments, $R^2$ is an aryl group. For example, $R^2$ may preferably be phenyl, tolyl, or xylyl.

Exemplary diisocyanates that may be used in forming the polycarbodiimide include, but are not limited to: MDI (in any the three isomers (2,2'-MDI, 2,4'-MDI, and 4,4'-MDI); m-phenylene diisocyanate; 2,4-toluene diisocyanate; 2,6-toluene diisocyanate; hexamethylene diisocyanate; 1,4-phenylene diisocyanate; tetramethylene diisocyanate; cyclohexane-1,4-diisocyanate; hexahydrotoluene diisocyanate; methylenediisocyanate; 2,6-diisopropylphenyl isocyanate; m-xylylene diisocyanate; dodecyl isocyanate; 3,3'-dichloro-4,4'-diisocyanato-1,1'-biphenyl; 1,6-diisocyanato-2,2,4-trimethylhexane; 3,3'-dimethoxy-4,4'-biphenylene diisocyanate; 2,2-diisocyanatopropane; 1,3-diisocyanatopropane; 1,4-diisocyanatobutane; 1,5-diisocyanatopentane; 1,6-diisocyanatohexane; 2,3-diisocyanatotoluene; 2,4-diisocyanatotoluene; 2,5-diisocyanatotoluene; 2,6-diisocyanatotoluene; isophorone diisocyanate; hydrogenated methylene bis(phenylisocyanate); naphthalene-1,5-diisocyanate; 1-methoxy-phenyl-2,4-diisocyanate; 1,4-diisocyanatobutane; 4,4'-biphenylene diisocyanate; 3,3'-dimethyldiphenylmethane-4,4'-diisocyanate; 4,4',4"-triphenylmethane triisocyanate; toluene-2,4,6-triisocyanate; 4,4'-dimethyldiphenylmethane-2,2',5,5'-tetraisocyanate; polymethylene polyphenylene polyisocyanate; or a mixture of any two or more thereof. In a preferred embodiment, the diisocyanate is 2,4-toluene diisocyanate, 2,6-toluene diisocyanate, or a mixture of 2,4- and 2,6-toluene diisocyanate. In one embodiment, the diisocyanate includes 100% 2,4-toluene diisocyanate. In another embodiment, the diisocyanate includes about 80% 2,4-toluene diisocyanate and about 20% 2,6-toluene diisocyanate. In another embodiment, the diisocyanate includes about 65% 2,4-toluene diisocyanate and about 35% 2,6-toluene diisocyanate.

Exemplary monoisocyanates that may be used in forming the capped polycarbodiimide include, but are not limited to: chlorosulfonyl isocyanate; trichloromethyl isocyanate; trichloroacetyl isocyanate; trichloroacetyl isocyanate; chloroacetyl isocyanate; vinyl isocyanate; methyl isocyanatoformate; 2-bromoethyl isocyanate; 2-chloroethyl isocyanate; 2-chloroethyl isocyanate; ethyl isocyanate; isocyanato (methoxy)methane; allyl isocyanate; ethyl isocyanatoformate; 3-chloropropyl isocyanate; isopropyl isocyanate; propyl isocyanate; (trimcthylsilyl)isocyanate; isocyanatocyclobutane; ethyl isocyanatoacetate; methyl (2s)-2-isocyanatopropanoate; butyl isocyanate; tert-butyl isocyanate; 1,1-dimethoxy-2-isocyanatoethane; cyclopentyl isocyanate; 2-isocyanato-2-methyl-propionic acid methyl ester; ethyl 3-isocyanatopropionate; (r)-(−)-3-methyl-2-butyl isocyanate; 1-isocyanato-2,2-dimethylpropane; 1-isocyanato-3-methylbutane; 3-isocyanatopcntane; pentyl isocyanate; 1-ethoxy-3-isocyanatopropane; pentafluorophenyl isocyanate; 4-bromo-2,6-difluorophenyl isocyanate; 2,4,6-tribromophenyl isocyanate; 2,3,4-trifluorophenyl isocyanate; 2,4,5-trifluorophenyl isocyanate; 4-bromo-1-chloro-2-isocyanatobenzene; 4-bromo-2-fluorophenyl isocyanate; 1-chloro-3-fluoro-2-isocyanatobenzene; 2-chloro-3-fluorophenylisocyanate; 3-chloro-4-fluorophenyl isocyanate; 4-chloro-2-fluorophenyl isocyanate; 5-chloro-2-nitrophenyl isocyanate; 2,4-dichlorophenyl isocyanate; 2,6-dichlorophenyl isocyanate; 3,4-dichlorophenyl isocyanate; 3,5-dichlorophenyl isocyanate; 2-fluoro-4-iodophenyl isocyanate; 4-fluoro-2-nitrophenyl isocyanate; 2,4-difluorophenyl isocyanate; 2,4-difluorophenyl isocyanate; 2,5-difluorophenyl isocyanate; 2,6-difluorophenyl isocyanate; 3,4-difluorophenyl isocyanate; 3,5-difluorophenyl isocyanate; 2,1,3-benzothiadiazol-4-yl isocyanate; 3,5-dinitrophenyl isocyanate; 3,5-dinitrophenyl isocyanate; 2-bromophenyl isocyanate; 3-bromophenyl isocyanate; 4-bromophenyl isocyanate; 2-chlorophenyl isocyanate; 3-chlorophenyl isocyanate; 3-chlorophenyl isocyanate; 4-chlorophenyl isocyanate; 2-chlorobenzenesulfonyl isocyanate; 4-(chloro sulfonyl) phenyl isocyanate; 4-chlorobenzenesulfonyl isocyanate; 2-fluorophenyl isocyanate; 3-fluorophenyl isocyanate; 4-fluorophenyl isocyanate; 4-fluorobenzenesulfonyl isocyanate; 2-iodophenyl isocyanate; 3-iodophenyl isocyanate; 4-iodophenyl isocyanate; 2-nitrophenyl isocyanate; 3-nitrophenyl isocyanate; 4-nitrophenyl isocyanate; phenyl isocyanate; phenyl isocyanate; benzenesulfonyl isocyanate; 2-isocyanatoethyl methacrylate; (isocyanatomethyl) cyclopentane; cyclohexyl isocyanate; 2-isocyanato-3-methyl-butyric acid methyl ester; butyl isocyanatoacetate; ethyl 4-isocyanatobutyrate; methyl (2s)-2-isocyanato-4-(methylsulfanyl)butanoate; hexyl isocyanate; 4-bromo-2-(trifluoromethyl)phenyl isocyanate; 2-chloro-4-(trlfluoromethyl)phenyl isocyanate; 2-chloro-6-(trifluoromethyl)phenyl isocyanate; 4-chloro-3-(trifluoromethyl)phenyl isocyanate; 5-chloro-2-isocyanatobenzonitrile; 5-fluoro-2-isocyanatobenzonitrile; 2-fluoro-3-(trifluoromethyl)phenyl isocyanate; 2-fluoro-5-(trifluoromethyl)phenyl isocyanate; 3-fluoro-5-(trifluoromethyl)phenyl isocyanate; 4-fluoro-2-(trifluoromethyl)phenyl isocyanate; 4-fluoro-3-(trifluoromethyl)phenyl isocyanate; 3-isocyanatobenzoy] chloride; 4-isocyanatobenzoyl chloride; 2-(trifluoromethyl)phenyl isocyanate; 3-(trifluoromethyl)phenyl isocyanate; 4-(trifluoromethyl)phenyl isocyanate; 4-(trifluoromethylthio)phenyl isocyanate; 2-(trifluoromethoxy)phenyl isocyanate; 4-(trifluoromethoxy)phenyl isocyanate; 3-cyanophenyl isocyanate; 4-cyanophenyl isocyanate; 4-bromo-2-chloro-6-methylphenyl isocyanate; 2,4-dichlorobenzyl isocyanate; 3,4-dichlorobenzyl isocyanate; 2-(difluoromethoxy)phenyl isocyanate; 4-(difluoromethoxy)phenyl isocyanate; benzoyl isocyanate; 3,4-(methylenedioxy)phenyl isocyanate; phenyl isocyanatoformate; 4-bromo-3-methylphenylisocyanate; 4-bromobenzyl isocyanate; 2-(chloromethyl)phenyl isocyanate; 2-chloro-5-methylphenyl isocyanate; 2-chloro-6-methylphenyl isocyanate; 2-chlorobenzyl isocyanate; 3-chloro-2-methylphenyl isocyanate; 3-chloro-4-methylphenyl isocyanate; 4-(chloromethyl)phenyl isocyanate; 4-chlorobenzyl isocyanate; 5-chloro-2-methylphenyl isocyanate; 5-chloro-2-methoxyphenyl isocyanate; 2-fluoro-5-methylphenyl isocyanate; 2-fluorobenzyl isocyanate; 3-fluoro-2-methylphenyl isocyanate; 3-fluoro-4-methylphenyl isocyanate; 3-fluorobenzyl isocyanate; 4-fluoro-3-methylphenyl isocyanate; 4-fluorobenzylisocyanate; 5-fluoro-2-methylphenyl isocyanate; 4-fluorobenzyl isothiocyanate; 2-methyl-3-nitrophenyl isocyanate; 2-methyl-4-nitrophenyl isocyanate; 4-methyl-2-nitrophenyl isocyanate; 5-methyl-2-nitrophenyl isocyanate; 2-methoxy-4-nitrophenyl isocyanate; 4-methoxy-2-nitrophenyl isocyanate; benzyl isocyanate; m-tolyl isocyanate; o-tolyl isocyanate; p-tolyl isocyanate; 2-methoxyphenyl isocyanate; 3-methoxyphenyl isocyanate; 4-methoxyphcnyl isocyanate; o-toluenesulfonyl isocyanate; p-toluenesulfonyl isocyanate; cycioheptyl isocyanate; cyclohexanemethyl isocyanate; 6-isocyanatohexanoic acid methyl ester; methyl (2s)-2-isocyanato-4-methylpentanoate; ethyl 2-isocyanato-4-(methylthio) butyrate; (r)-(−)-2-heptyl isocyanate; (s)-(+)-2-heptyl isocyanate; heptyl isocyanate; 3,5-bis(trifluoromethyl)phenyl isocyanate; 2-isocyanato-5-methylbenzonitrile; 4-isocyanatobenzyl cyanide; 2,4-dichlorophenethyl isocyanate; 3,4-dichlorophenethyl isocyanate; 4-acetylphenyl isocyanate; methyl 2-isocyanatobenzoate; methyl 3-isocyanatobenzoate; methyl 4-isocyanatobenzoate; (s)-(−)-1-(4-bromophenyl)ethyl isocyanate; 4-bromo-2,6-dimethylphenyl isocyanate; 4-bromo-2-ethylphenyl isocyanate; (r)-(+)-1-(4-chlorophenyl)ethyl isocyanate; 3-chlorophenethyl isocyanate; 4-chlorophenethyl isocyanate; (r)-(+)-1-(4-iluorophenyl)ethyl isocyanate; (s)-(−)-1-(4-fluorophenyl)ethyl isocyanate; 2-fluorophenethyl isocyanate; 4-fluorophenethyl isocyanate; 2,3-dimethyl-6-nitrophenyl isocyanate; 4-ethoxy-2-nitrophenyl isocyanate; 2,5-dimethylphenyl isocyanate; 2,6-dimethylphenyl isocyanate; 2-methylbenzyl isocyanate; 3,5-dimethylphenyl isocyanate; 3-methylbenzyl isocyanate; 4-ethylphenyl isocyanate; 4-methylbenzyl isocyanate; phenethyl isocyanate; 2-methoxy-5-methylphenyl isocyanate; 2-methoxybenzyl isocyanate; 3-ethoxyphenyl isocyanate; 3-methoxybenzyl isocyanate; 4-methoxybenzyl isocyanate; 1-isocyanato-2,3-dimethoxybenzene; 2,4-dimethoxyphenyl isocyanate; 2,5-dimethoxyphenyl isocyanate; 2,6-dimethoxyphenyl isocyanate; 3,4-dimethoxyphenyl isocyanate; 3,5-dimethoxyphenyl isocyanate; 4-(dimethylamino)phenyl isocyanate; ethyl 2-isocyanato-4-methylvalerate; ethyl 6-isocyanatohexanoate; (r)-(−)-2-octyl isocyanate; (s)-(+)-2-octyl isocyanate; 1,1,3,3-tetramethylbutyl isocyanate; 2-ethylhexyl isocyanate; octyl isocyanate; 5-ethyl-2-isocyanatobenzonitrile; (s)-(+)-1-indanyl isocyanate; 5-indanyl isocyanate; trans-2-phenylcyclopropyl isocyanate; 3,4-methylenedioxyphenethyl isocyanate; ethyl 2-isocyanatobenzoate; ethyl 3-isocyanatobenzoate; ethyl 4-isocyanatobenzoate; methyl 3-isocyanato-2-methylbenzoate; 3-bromo-2,4,6-trimethylphenyl isocyanate; (r)-(+)-1-phenylpropyl isocyanate; (s)-(−)-1-phenylpropyl isocyanate; 2-ethyl-6-methylphenyl isocyanate; 3-phenylpropyl isocyanate; (r)-(+)-1-(3-methoxyphenyflethyl isocyanate; (r)-(+)-1-(4-methoxyphenyl)ethyl isocyanate; (s)-(−)-1-(3-methoxyphenyl)ethyl isocyanate; 1-ethoxy-4-isocyanato-2-methoxybenzene; 2,4-dimethoxybcnzyl isocyanate; 3,4,5-trimethoxyphenyl isocyanate; (r)-(−)-2-nonyl isocyanate; (s)-(+)-2-nonyl isocyanate; 1-naphthyl isocyanate; 2-naphthyl isocyanate; dimethyl 2-isocyanatoterephthalate; dimethyl 5-isocyanatoisophthalate; 1-isocyanato-1,2,3,4-tetrahydronaphthalene; ethyl (4-isocyanatophenyl)acetate; 2,6-diethylphenyl isocyanate; 4-butylphenyl isocyanate; 4-ethylphenethyl isocyanate; 4-phenylbutyl isocyanate; 4-sec-butylphenyl isocyanate; 4-tert-butylphenyl isocyanate; 2,3-dimethoxyphenethyl isocyanate; 2,5-dimethoxyphenethyl isocyanate; 3,4-dimethoxyphenethyl isocyanate; 3,4,5-trimethoxybenzyl isocyanate; 1-adamantyl isocyanate; ethyl 4-(isocyanatomethyl)cyclohexanecarboxylate; decyl isocyanate; 8-(isocyanatomethyl)-6h-[1,3]dioxolo[4,5-g]chromen-6-one; 2-ethyl-6-isopropylphenyl isocyanate; 4-butyl-2-methylphenyl isocyanate; 4-pentylpheny] isocyanate; undecyl isocyanate; 4-chloro-2-phenoxyphenyl isocyanate; 5-chlofo-2-phenoxyphenyl isocyanate; 2-biphenylyl isocyanate; 4-biphenylyl isocyanate; 3-phenoxyphenyl isocyanate; 4-phenoxyphenyl isocyanate; p-phenylazophenyl isocyanate; 1-(1-naphthyl)ethyl isocyanate; (1r,2r)-(−)-2-benzyloxycyclopentyl isocyanate; 4,4'-oxybis(phenyl isocyanate); 9h-fluoren-2-yl isocyanate; 9h-fluoren-9-yl isocyanate; 4-isocyanatobenzophenone; 2-benzylphenyl isocyanate; 4-benzylphenyl isocyanate; diphenylmethyl isocyanate; 4-(benzyloxy)phenyl isocyanate; (1r,2r)-(−)-2-benzyloxycyclohexyl isocyanate; (1s,2s)-(+)-2-benzyloxycyclohexyl isocyanate; 2,2-diphenylethyl isocyanate; 2-(4-biphenyl)ethyl isocyanate; 4'-isocyanatobenzo-15-crown-5; 2,5-di-tert-butylphenyl isocyanate; tetradecyl isocyanate; n-fmoc-isocyanate; 3,3-diphenylpropyl isocyanate; 2,2-bis(4-isocyanatophenyl)hexafluoropropane; hexadecyl isocyanate; or octadecyl isocyanate. In one embodiment, the monoisocyanate is an aromatic isocyanate. Mixtures of any two or more monoisocyanates may also be used.

In certain embodiments, the diisocyanate is selected from 2,4-toluene diisocyanate, 2,6-toluene diisocyanate, and combinations thereof, and the monoisocyanate is an aromatic monoisocyanate. For example, from a chemical reaction standpoint, the capped polycarbodiimide may be prepared according to the reaction described in Scheme 2 below:

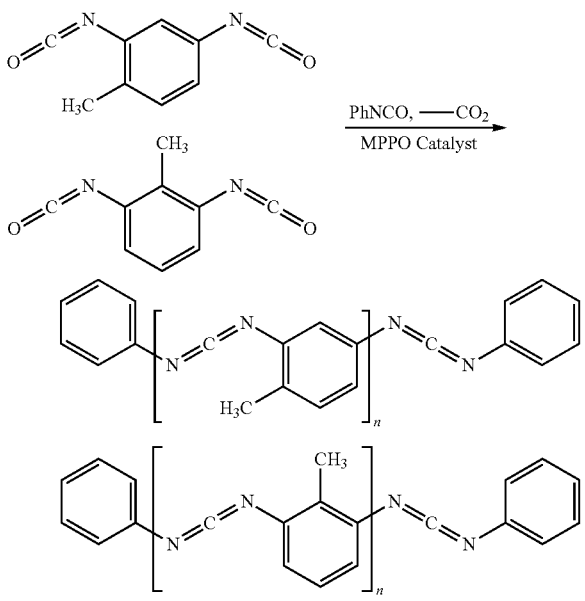

Suitable isocyanates for use in forming the capped polycarbodiimide are commercially available from BASF Corporation of Florham Park, N.J. under the trade name LUPRANATE®.

Similar to the first embodiment, the method for application of capped polycarbodiimide as a coating may be done by any known conventional paperboard coating techniques, such as by the use of a draw down bar, spray coating, etc. Prior to application, the paperboard or paper media may be cleaned or otherwise prepared to remove loose fibers or debris.

In applications wherein a draw down bar is utilized for application, the applied coating of the capped polycarbodiimide is pressed within its surface and into the porous paperboard and/or paper media (i.e., the applied capped polycarbodiimide infiltrates or otherwise impregnates the paperboard or paper media) and as such substantially coats the fibers or structure of the paperboard or paper media.

After application, the coating of the applied capped polycarbodiimide generally adheres to the paperboard or paper media.

Adhering, as defined herein, refers to the interaction of the capped polycarbodiimide with the paperboard or paper media. In this regard, the adherence may be in the form of mechanical adhesion, wherein the applied coating of the capped polycarbodiimide fills the voids or pores in the surface of the paperboard or paper media in terms of interlocking or impregnation, particularly wherein the draw down bar is used as the application technique as described above. In addition, the adherence may be in the form of chemical adhesion, wherein the adhesion of the applied coating of the capped polycarbodiimide to the paperboard or paper media may be in the form of ionic bonding and hydrogen bonding. In addition, the adherence may also include the formation of covalent bonds and the like between the applied coating of the capped polycarbodiimide and the paperboard or paper media, although the primary mode of adhering is not generally defined in terms of a chemical reaction between the applied coating of the capped polycarbodiimide and the paperboard or paper media. Still further, the adherence may be in the form of other adhesion phenomenon such as van der Waals forces, dispersive adhesion, electrostatic adhesion and diffusive adhesion between the applied coating of the capped polycarbodiimide and the paperboard or paper media.

In this embodiment, because the capped polycarbodiimide is designed to be substantially or completely free of unreacted isocyanate groups (i.e., the NCO content is approximately 0), the strength enhancement resulting from the application of the coating of the capped polycarbodiimide is believed to be the result of the inherent strength of the capped polycarbodiimide itself as well as being due in part to the association with the adherence of the capped carbodiimide with the paperboard or paper media. As such, as noted above, the weight average molecular weight of the applied capped carbodiimide is at least 4,500, and more typically from 5,500 to 30,000 g/mol (Daltons).

Paperboards or paper media (i.e., unbleached kraft, solid bleached sulphate board or 100% recycled board) treated in accordance with any of the methods described herein achieved increased strength under both dry and wet testing methodologies as compared with untreated paperboards and paper media of the same basis weight. In certain embodiments, the average wet tensile strength measurements of these treated paperboards yielded more than an 80% improvement as compared with untreated paperboards and paper media of the same basis weight. The present invention therefore allows the use of treated paperboards or paper media with reduced basis weight to achieve a similar and/or improved strength, and increased barrier properties, as compared to untreated paperboards or paper media of a higher basis weight.

The following examples are intended to illustrate the invention and are not to be viewed in any way as limiting to the scope of the invention.

EXAMPLES

Measurement and Application Equipment

The resultant NCO content and viscosity of various experimental samples of Examples 1 and 2 below were measured and compared against known standards for quality verification.

A Metrohm 798 Titrator was employed to measure % NCO (i.e., the NCO content, or % NCO value). The experimental sample was reacted and derivatized with dibutylamine for 5 minutes under moderate heat and stirring. The excess dibutylamine was titrated against methanol and the % NCO value was then back calculated given the known concentration and volume of methanol used. Samples were tested in duplicate and the average reported. Viscosity was determined by a Brookfield Rheometer fitted with a #21 spindle. Measurements were taken after 20 minutes of conditioning at 25° C.

A K101 Control Coater by RK Print Coat Instruments LTD was used to prepare and treat the paperboards of Examples 1 and 2. Gardco 12" OA ⅜" diameter (30.5 cm OA 0.95 cm diameter) #00 and #03 wire wound JR rods by Paul N Gardner Company, Inc. were used with the K Control Coater. Drawdown speeds were adjusted from 0 to 10 variable units depending upon the viscosity of the coating composition and the internal sizing of the substrates employed to achieve a desired coating weight.

Various substrates were employed (i.e. 14 point Uncoated Unbleached Kraft from MWV, 18 point Coated Recycled Board from Cascades) for application and testing. Each substrate was cut into 7" by 14" sheets (17.8 cm by 35.6 cm) and affixed to the K coater platform.

Isocyanate-Terminated Prepolymer Preparation (for Use in Example 1 Below):

PMDI, a modified prepolymer of 4,4' MDI and 2,4' MDI, was charged into a flask. The contents were heated to 60 degrees Celsius under agitation, wherein additional 4,4' MDI was added and the contents stirred for 15 minutes. Next, a difunctional polyester polyol (Millester 16-30 polyol, available from Huntsmen Chemical) was added to the flask under agitation and the components stirred for 1 hour at 80 degree Celsius to form the isocyanate-terminated prepolymer. The formed isocyanate-terminated prepolymer was removed from the heat and cooled to room temperature prior to usage.

Capped Carbodiimide Preparation (for Use in Example 2 Below):

TDI, triphenyl phosphate (TPP) and phenyl isocyanate were charged into a flask. The contents were heated to 70 degrees Celsius under agitation, wherein 3-methyl-1-phenyl-2-phospolene 1-oxide (MPPO) was added to the flask under agitation and the components stirred for 1 hour at 120 degree Celsius. A second portion of MPPO was added under agitation and the components stirred for 6 hours at 120 degree Celsius to form the capped carbodiimide polymer. The formed capped carbodiimide polymer was removed from the heat and cooled to room temperature prior to usage. Optionally, the capped carbodiimide could be mixed with a solvent such as triethyl phosphate, n-butyl acetate, t-butyl acetate, or ethyl acetate prior to usage to allow better flow and penetration within the paperboard upon application.

Example 1: Two-Component Application and Testing Process

The two-component coating system for the reactive polyisocyanate and amine chemistry was applied as follows (Coating Order B of Table A below): With 14 point unbleached kraft paperboard from MWV and the #00 rod affixed to the K coater platform, 5 mL of the reactive polyisocyanate (polymeric MDI or the isocyanate-terminated prepolymer, as described in Table A below) was applied to the base of the drawdown rod. With the speed setting at 10, the K coater was switched forward and the chemistry was pushed down the substrate. The residual reactive polyisocyanate was wiped off the substrate surface; the drawdown rod was removed, cleaned with acetone and returned to the top of the K coater platform.

Next, 5 mL of triethylenediamine solution in dipropylene glycol (i.e., the solution including an amine catalyst described in Table B below) was applied to the base of the drawdown rod. Continuing at speed setting 10, the K coater was switched forward and the chemistry was pushed down the substrate. The residual solution (a) was wiped off the substrate surface and the coated paperboard formed via the two-component application process was removed from the coating platform to cure.

In Coating Order A (see Table A below), the order of application of the reactive polyisocyanate and the solution was reversed (i.e., wherein the solution as described above was applied first, followed by the application of the reactive isocyanate onto the solution in a manner similar to the matter of Coating Order B above).

The two-component applications, formed in accordance with the examples shown in Table B below, experienced no blocking in the resultant paper roll and were cured in open air after 4 minutes, and which the respective samples were submitted for physical testing.

The treated paperboard samples were tested and compared against an untreated control from the same baseline paperboard as the treated paperboard samples. In each physical property test, the treated sample and an untreated sample were tested for comparison. For example, all wet strength testing required each sample, treated and untreated, to be submerged in deionized water for 30 minutes and blotted dry before undergoing tear testing.

The results are provided in Table A below:

TABLE A

| Two-Component Treated Paperboards | | | | | | |
|---|---|---|---|---|---|---|
| | | | Strength & Barrier Results | | | |
| Coating Treatment | Coating Order | % NCO | Cobb 30 Min ($g/m^2$) | Wet Tensile (Pascals) | Wet Tear MD (mN) | Wet Tear CD (mN) |
| Uncoated Blank | N/A | 0.00 | 131.84 | 104.52 | 2325.35 | 2530.90 |
| Polymeric MDI (32% High Ring Structure) | — | 31.5 | 75.72 | 130.24 (+24.60%) | 2108.82 (−21.13%) | 3621.40 (+27.37%) |
| Polymeric MDI (32% High Ring Structure) | A | 31.5 | 86.54 | 174.02 (+66.55%) | 3160.10 (+35.90%) | 4085.84 (+61.44%) |
| Polymeric MDI (32% High Ring Structure) | B | 31.5 | 73.92 | 186.36 (+78.35%) | 3706.13 (+59.38%) | 3853.62 (+52.26%) |
| MDI Prepolymer with Polyether Polyol and Crosslinker (difunctional alcohol) | — | 22.8 | — | — | 2343.13 (+0.07%) | 2798.16 (+10.26%) |
| MDI Prepolymer with Polyether Polyol and Crosslinker (difunctional alcohol) | A | 22.8 | 88.88 | 152.99 (+46.40%) | 3226.00 (+38.73%) | 3900.69 (+54.12%) |
| MDI Prepolymer with Polyether Polyol. Crosslinker (difunctional alcohol) and castor oil | A | 20.4 | 87.92 | 150.86 (+44.34%) | 3489.60 (+50.07%) | 4227.06 (+67.02%) |

Example 2: Capped Polycarbodiimide Application and Testing Process

The capped polycarbodiimide (formed as above) was coated on 14 point unbleached kraft paperboard from MWV using the #00 drawdown rod and speed setting 10. With the substrate and drawdown rod affixed, excess capped polycarbodiimide, approximately 5 mL, was applied at the base of the drawdown rod in a steady stream at the top of the substrate sheet. The K coater was switched forward and the drawdown rod automatically moved down the substrate. The residual capped polycarbodiimide was wiped off the substrate surface and the coated paperboard was removed from the coating platform.

The treated substrates as presented in Table B were dried in open air for at least 15 minutes to allow the capped polycarbodiimide polymer to penetrate the paperboard and to allow any residual solvent present (if used) to dry.

The treated paperboard was tested and compared against untreated paperboard of the same basis weight. In each physical property test as illustrated below, the treated sample and untreated sample were tested under the same conditions for comparison. For all wet strength testing, each sample (untreated or treated) was submerged in deionized water for 30 minutes and blotted dry prior to under going testing. The results are provided in Table B below:

TABLE B

| Capped Polycarbodiimide Polymer (pCDI) | | | | | | |
|---|---|---|---|---|---|---|
| | | | Strength & Barrier Results | | | |
| Coating Treatment | MW | % NCO | Cobb 30 Min ($g/m^2$) | Wet Tensile (Pascals) | Wet Tear MD (mN) | Wet Tear CD (mN) |
| Uncoated Blank | N/A | 0.00 | 92.38 | 169.89 | — | — |
| 2-ethylhexanol capped TDI polycarbodiimide | 4850 | ~0.00 | — | 181.88 (+7.06%) | — | — |
| 2-propylheptanol capped TDI polycarbodiimide | 5750 | ~0.00 | — | 203.74 (+19.92%) | — | — |

TABLE B-continued

| Capped Polycarbodiimide Polymer (pCDI) | | | | | | |
|---|---|---|---|---|---|---|
| | | | Strength & Barrier Results | | | |
| Coating Treatment | MW | % NCO | Cobb 30 Min ($g/m^2$) | Wet Tensile (Pascals) | Wet Tear MD (mN) | Wet Tear CD (mN) |
| Phenyl Isocyanate capped TDI poly-carbodiimide | 10 000 | ~0.00 | 52.46 | 340.26 (+100.30%) | — | — |

Example 3: Further Examples of Two-Component Application and Testing Process

An OMET VaryFlex 530 press was used to prepare and treat paperboards. Solid Omet anilox rolls with 60 degree cell angles and load cells of 5 and 8 BCM/sq. in. ("billions of cubic microns per square inch", which corresponds to 1.55 $cm^3/m^2$) were used with the press. Banded Omet anilox rolls with 60 degree cell angles and cell sizes of 1.03, 1.53, 1.75, 2.22, 2.85, 3.58, 4.09, 4.43, 5.08, 5.86, 6.41, 6.95, 8.0, 10, 12, 16, 18, and 20 BCM were also employed. Natural rubber transfer rollers with disposable plastic doctor blades were used in each press unit for application. Various substrates were employed (i.e. 36# linerboard from RockTenn, 14 point Coated Recycled Board from Cascades) for application and testing. Each substrate was rolled and fed through the press at speeds of 50, 100, 175, and 200 ft./min. (i.e., 15.24, 30.48, 53.34 and 60.94 meters/minute). Two press units were used consecutively under ambient conditions without drying.

The two-component coating system for the reactive polyisocyanate and amine chemistry was applied using a flexographic press as follows (coating order A of Table A described above): With triethylenediamine solution in dipropylene glycol (i.e., the solution including an amine catalyst described in Table B above) loaded in unit 1 of the Omet VaryFlex 530 press fitted with an Omet Anilox roll of 3 BCM/sq. in. (4.65 $cm^3/m^2$), and the reactive polyisocyanate (polymeric MDI (32% High Ring Structure), as described in Table A) loaded in unit 2 (or any subsequent unit to that of the amine) of the press fitted with an Omet Anilox roll of 5 BCM/sq. in. (7.75 $cm^3/m^2$), 36# linerboard from RockTenn was fed through the press at about 15 m/min (50 ft/min). The pressure on the paperboard from the transfer roller was adjusted in line to begin printing; more than 30.5 meters of substrate (i.e., more than 100 feet of substrate) was coated continuously, machine rolled, and left to cure in open air. The two component coating system was applied by this method. The results are provided in Table C below:

TABLE C

| Two-Component Treated Paperboards | | | | | | |
|---|---|---|---|---|---|---|
| | Line | Aqueous | Isocyanate | Coating | Strength & Barrier Results | |
| Coating Treatment | Speed (m/min) | Band ($cm^3/m^2$)[1] | Band ($cm^3/m^2$)[1] | Weight (gsm) | Wet Tear MD (mN) | Wet Tear CD (m/N) |
| Uncoated Blank | N/A | N/A | N/A | 0.00 | 868.40 | 957.76 |
| Polymeric MDI, 32% high ring structure | 15.24 | 7.75 | 12.4 | 4.87 | 899.66 (+3.6%) | 1064.73 (+11.2%) |
| | | 7.75 | 15.5 | 5.74 | 1073.01 (+23.6%) | 1385.25 (+44.6%) |
| | | 7.75 | 18.6 | 7.26 | 1225.56 (+41.1%) | 1863.22 (+94.5%) |
| | | 7.75 | 24.8 | 8.32 | 1126.28 (+29.7%) | 2250.63 (+135.0%) |
| | | 7.75 | 27.9 | 10.44 | 1346.30 (+55.0%) | 1773.2 (+85.1%) |
| | | 7.75 | 31 | 12.41 | 1348.57 (+55.3%) | 1820.98 (+90.1%) |
| Polymeric MDI, 32% high ring structure | 15.24 | 7.75 | 8 | 4.95 | 935.79 (+7.8%) | 1010.32 (+5.5%) |
| Polymeric MDI, 32% high ring structure | 15.24 | 4.65 | 5 | 3.01 | 1058.65 (+21.9%) | 1156.72 (+20.8%) |

[1]1.55 $cm^3/m^2$ = 1 BCM/sq. in)

It is to be understood that the appended claims are not limited to express and particular compounds, surface treatment materials, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner, and it is to be understood that the terminology which has been used is intended to be in the nature of words of description rather than of limitation. Obviously, many modifications and variations of the present invention are possible in light of the above teachings. The invention may be practiced otherwise than as specifically described.

What is claimed is:

1. A method for treating paperboard or paper media comprising the steps of: providing a first composition which comprises at least one component selected from a multifunctional alcohol, an amine, an amine derivative, a tin-based catalyst, and combinations thereof;

providing a second composition comprising an isocyanate component; applying one of the first composition and the second composition onto a surface of the paperboard or paper media; applying the other of the first composition and the second composition onto the surface of the paperboard or paper media to form polyurethanes, polyureas, and/or polycarbodiimides, wherein the isocyanate component is selected from the group of methylene diphenyl diisocyanate, polymethylene polyphenylisocyanate, an isocyanate-terminated prepolymer, a carbodiimide polymer having unreacted isocyanate groups, and combinations thereof, wherein the first and second compositions are applied in either order to produce a treated paperboard or paper media.

2. The method according to claim 1, wherein the isocyanate component comprises methylene diphenyl diisocyanate (MDI), polymethylene polyphenyl diisocyanate (PMDI), or a combination of methylene diphenyl diisocyanate (MDI) and polymethylene polyphenylisocyanate (PMDI).

3. The method according to claim 1, wherein the isocyanate component is an isocyanate-terminated prepolymer that comprises a reaction product of:

an active hydrogen-containing species; and methylene diphenyl diisocyanate (MDI) and/or polymethylene polyphenyl diisocyanate (PMDI).

4. The method according to claim 3, wherein the active hydrogen-containing species comprises a polyether polyol, a polyester polyol, a polyamine, or any combination thereof.

5. The method according to claim 4, wherein the active hydrogen-containing species comprises a polyester polyol.

6. The method according to claim 4, wherein the active hydrogen-containing species is a heteric polyol derived from the polymerization of ethylene oxide and propylene oxide.

7. The method according to claim 3, wherein the active hydrogen-containing species comprises a polyether polyol.

8. The method according to claim 3, wherein the active hydrogen-containing species comprises a polyester polyol.

9. The method according to claim 3, wherein the active hydrogen-containing species is a heteric polyol derived from the polymerization of ethylene oxide and propylene oxide.

10. The method according to claim 3, wherein the active hydrogen-containing species is an ethylene oxide/propylene oxide block copolymer.

11. The method according to claim 3, wherein the active hydrogen-containing species has a weight average molecular weight ranging from 76 to 5,500 g/mol.

12. The method according to claim 3, wherein the isocyanate-terminated prepolymer is present in the isocyanate component in an amount from 25 to 90 parts, based on 100 parts by weight of the isocyanate component.

13. The method according to claim 3, wherein the isocyanate component is an isocyanate-terminated prepolymer that has an NCO content of greater than 0 to 48 weight percent.

14. The method according to claim 3, wherein the isocyanate component is a carbodiimide polymer having unreacted isocyanate groups that is the self-polymerization product of methylene diphenyl diisocyanate formed in the presence of a carbodiimidization catalyst.

15. The method according to claim 3, wherein the first composition further comprises water, and wherein the concentration of the at least one component in the first composition is from greater than 10% to less than 100% based on the total combined weight of water and the at least one component.

* * * * *